United States Patent [19]

Yapoudjian et al.

[11] 4,350,405

[45] Sep. 21, 1982

[54] CONNECTOR FOR INSULATED ELECTRIC CONDUCTORS

[75] Inventors: Claude Yapoudjian, Chilly-Mazarin; Roger Pochet, La Bresse, both of France

[73] Assignee: Societe Anonyme dite: MARS-ACTEL, Paris, France

[21] Appl. No.: 232,044

[22] PCT Filed: May 21, 1980

[86] PCT No.: PCT/FR80/00084

§ 371 Date: Jan. 25, 1981

§ 102(e) Date: Jan. 13, 1981

[87] PCT Pub. No.: WO80/02775

PCT Pub. Date: Dec. 11, 1980

[30] Foreign Application Priority Data

May 25, 1979 [FR] France ..... 79 13326

[51] Int. Cl.[3] ..... H01R 11/20

[52] U.S. Cl. ..... 339/97 P

[58] Field of Search ..... 339/97 R, 97 P, 98

[56] References Cited

U.S. PATENT DOCUMENTS

| | | | |
|---|---|---|---|
| 2,694,189 | 11/1954 | Wirsching | 339/97 R |
| 3,027,536 | 3/1962 | Pasternak | 339/97 R |
| 3,761,866 | 9/1973 | Sedlacek | 339/97 P |
| 4,002,391 | 1/1977 | Dunn | 339/98 |
| 4,085,994 | 4/1978 | Volinski | 339/97 R X |
| 4,106,837 | 8/1978 | Paluch | 339/98 |
| 4,118,095 | 10/1978 | Berglund et al. | 339/99 R |

FOREIGN PATENT DOCUMENTS

| | | | |
|---|---|---|---|
| 2142850 | 3/1973 | Fed. Rep. of Germany . | |
| 2541064 | 3/1977 | Fed. Rep. of Germany . | |
| 2271682 | 12/1975 | France . | |
| 2343343 | 9/1977 | France . | |
| 906665 | 9/1962 | United Kingdom . | |
| 1276449 | 6/1972 | United Kingdom | 339/98 |

*Primary Examiner*—Joseph H. McGlynn
*Assistant Examiner*—John S. Brown
*Attorney, Agent, or Firm*—Sughrue, Mion, Zinn, Macpeak & Seas

[57] ABSTRACT

A connector for self-stripping insulated electric conductors, said conductor including a fork or clip type conductive connection part with at least two resilient arms between which is provided a slot for inserting the electric conductor to be connected, the connection part being designed for inserting in a cavity in a stand made of insulating material. The double fork type connection part (75) has two inclined slots (64, 65) whose axes converge towards the top of the connector. Application to electric connections, in particular in telecommunications.

5 Claims, 7 Drawing Figures

CONNECTOR FOR INSULATED ELECTRIC CONDUCTORS

SUMMARY OF THE INVENTION

The invention provides a connector for self-stripping insulated electric conductors, said connector including a fork or clip type conductive connection part with at least two resilient arms between which is provided a slot for inserting the electric conductor to be connected, the connection part being designed for insertion in a cavity in a stand made of insulating material, characterized in that the double fork type connection has two inclined slots whose axes converge towards the top of the connector.

In accordance with the invention, the connection part includes at least one very protruding boss on the inner edge of one of the arms of the connection part. The boss is located between the end and the opening of the slot and being intended firstly to calibrate the opening of the slot and secondly to hold the conductor in the slot after it has been installed therein. The boss is formed by snarling, coining, swaging or like means performed near the edge of said slot but at some distance from said edge so as not to reduce the thickness of the part at its edge.

In accordance with the invention, the connection part middle arm has a hole, in which a stud on the support fits, to hold the middle arm motionless when a conductor is inserted in one of the slots of the connection part.

In accordance with the invention, a connection part provided with two contact arms which press in opposite directions to the arms of the fork includes a bridge portion which connects the two connection part arms together so as to prevent the ends of the contact arms from moving when a conductor is inserted in the fork.

The figures of the accompanying drawings illustrate several embodiments of a connector in accordance with the invention.

DESCRIPTION OF PREFERRED EMBODIMENTS

Figure 1:
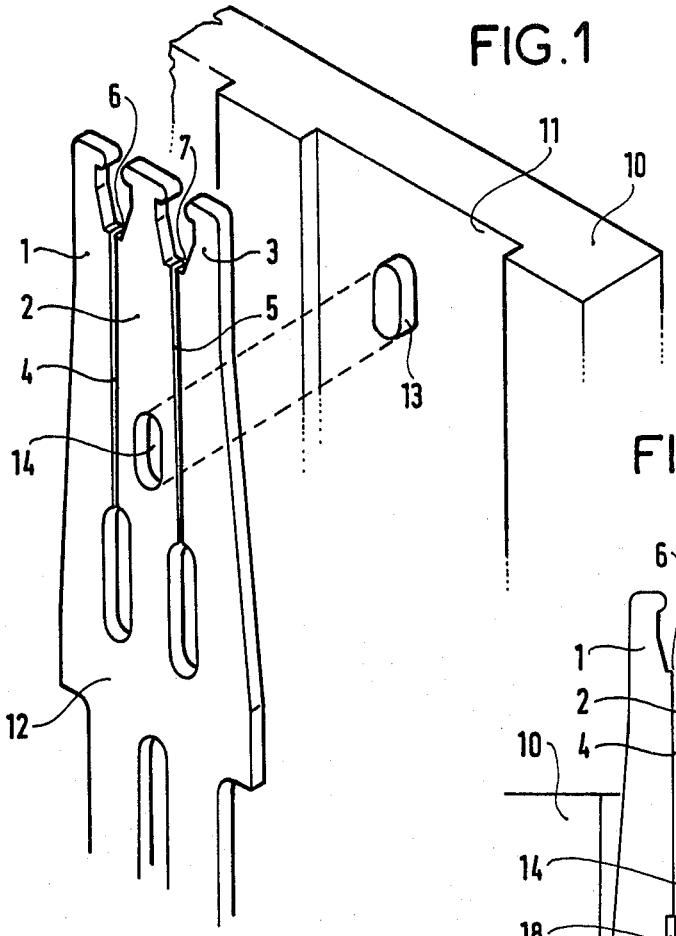
FIG. 1 is an exploded, perspective view of a fork type connector separated and its support.

The forked connection part illustrated in the figures is made from a springy metal substance in accordance with a known manufacturing process.

It is constituted by three arms: a left side arm 1, a middle arm 2 and a right side arm 3.

V-shaped slots are provided between the arms: a left slot 4 and a right slot 5 whose openings 6 and 7 have strictly identical dimensions and are adapted to the diameters of the conductors.

One after another, the conductors are driven into their respective slots up to the required distance from the inlet orifices.

Figure 2:
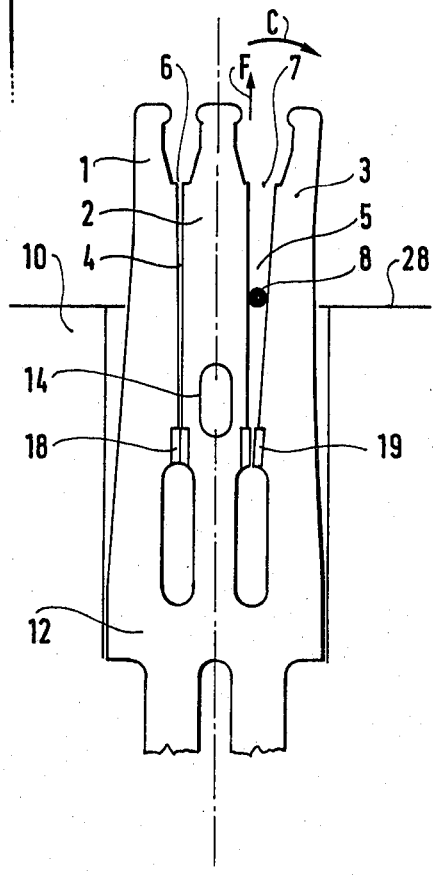
FIG. 2 is an elevation which shows a connector with a double fork recessed in its support.

A conductor 8 is pushed into the slot 5 (as shown in FIG. 2). As the conductor moves, the resilient arms 2 and 3 are progressively pushed apart. This increases the width of the opening 7 and also more especially would reduce the width of the opening 6 if the central arm were not held straight.

Such reduction in the width of the opening 6 is undesirable since a conductor could then not be inserted in its slot 4 in the same conditions as the conductor 8 in the slot 5. In particular, the effort needed to insert the conductor would be greater and exerting such an effort could break the conductor.

One particularity of the present invention is that it remedies this kind of drawback.

An insulating support 10 for a connection fork 12 has a recess 11 within which a rigid stud 13 projects from support 10, designed to fit into a hole 14 provided in the middle arm 2 of the connection fork. In these conditions, inserting the conductor 8 in the slot 5 progressively moves the right arm 3 away from the middle arm 2 in the direction of the arrow C. Only the side arm 3 moves since the middle arm 2 is held motionless by the stud 13 which passes through orifice 14. Consequently, the width of the opening 6 in the slot 4 no longer varies and therefore, the widths of the openings remains well adapted to the diameters of the conductors which are to be inserted.

Several methods may be used to provide open slots in connection forks. In accordance with one of these methods (FIG. 2), after cutting the connection fork out of the metal in a conventional manner, parallel slots 4 and 5 which are not yet splayed open are formed without removing any metal. The slots are then splayed open by two portions 18 and 19 of the metal at the bases of the slots 4 and 5. This moves the metal inside the slots and therefore pushes aside the side arms 1 and 3, thus forming openings 6 and 7. The widths of the openings 6 and 7 vary, depending on the extent to which the portions 18 and 19 are crushed. Therefore, to adapt the widths of the openings 6 and 7 precisely and accurately to the diameters of the conductors, the crushed portions 18 and 19 must be accurately calibrated.

FIG. 2 illustrates a conventional use of a connection fork. Here, the connection fork 12 is placed in its insulating support 10. A conductor wire 8 is inserted in the slot 5 until it bears against upper surface 28 of the insulating support 10. In this figure, the middle arm 2 of the connection fork is held motionless by the stud 13 integral with the insulating support 10 which passes through the orifice 14 of said middle arm 2. The crushed portions 18 and 19 are below the bearing surface 28. In another respect, if traction is exerted on the conductor wire 8 in the direction shown by arrow F, the conductor wire comes out of the connection fork; obviously, retention of the wire in the connection fork is directly related to the mechanical pressure exerted by the arms of the fork on the wire.

Figure 3:
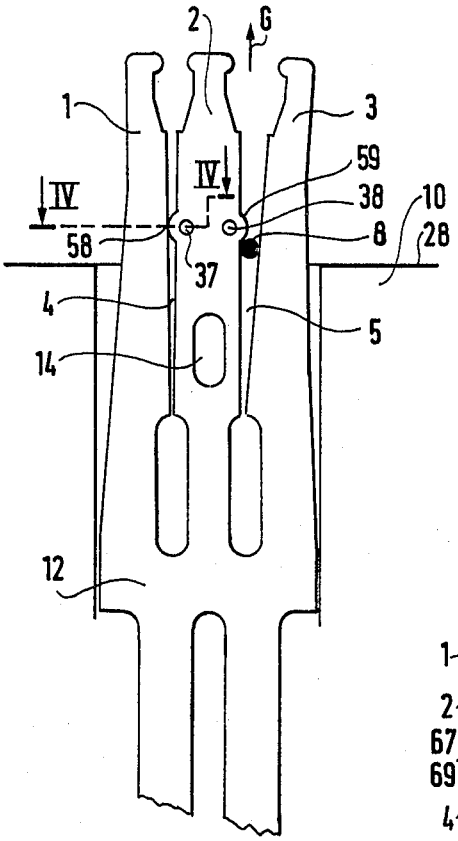
FIG. 3 is an elevation which shows another embodiment of a connector in its support.

FIG. 3 illustrates an embodiment in which the accuracy of the crushing can be reduced while the conductor wire is better retained in the slot of the connection fork.

The fork is made as previously explained. Lastly, the spacing between the middle arm 2 and the side arms 1 and 3 is set by crushed portions 37 and 38 and by displacing the metal of the middle arm 2 not at the bases of the slots 4 and 5 but at intermediate points between the bases and the tops of the slots. These crushed portions form bosses 58, 59.

On comparing FIGS. 2 and 3, it can be observed that, for the openings at the tops of the slots to be set at the same width, it is certainly necessary to shift less material in the crushing method illustrated in FIG. 2 than in that illustrated in FIG. 3; in contrast, the slightest difference in crushing rapidly causes an appreciable difference in the opening width due to the great distance of the crushed portions from the tops of the slots.

FIG. 3 shows clearly that for the same opening width, the extent of crushing is less critical than in the case of FIG. 2 due to the shorter distance of the crushed portions from the tops of the slots.

The right-hand side of FIG. 3 shows an example of how the connection fork is used. With the connection fork placed in its insulating support 10, the middle arm 2 is held motionless by the stud 13 which passes through the hole 14 in the middle arm. A conductor wire 8 is inserted in the slot 5 until it presses against the upper surface 28 of the insulating support 10. At that instant, the conductor wire 8 is below the level of the crushed portion 38. The surface 28 therefore determines the lower limit of the position which the boss 59 can assume.

If the traction is then exerted on the conductor wire 8 in the direction of arrow G, it is observed that, in that case, the wire is retained considerably better compared with the case of FIG. 2, since besides the mechanical pressure exerted on the wire by the arms of the connection fork, the projection of the crushed portion 38 forms a mechanical abutment.

Figure 4:
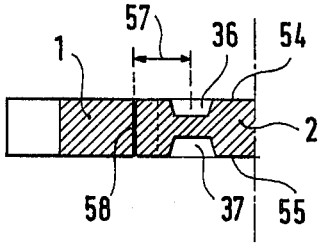
FIG. 4 is a detailed cross-section view along line IV—IV of FIG. 3.

Crushing the material which forms the abutment must not reduce the thickness of the metal in the bearing zone 58 where the boss 59 presses against the opposite arm (see the cut IV—IV of FIG. 3 illustrated in FIG. 4). The portions 36 and 37 are crushed simultaneously with a punch full in the material on both surfaces 54 and 55 of the arm 2 at a distance 57 from the bearing zone 58, thus pushing back the material on both surfaces 54 and 55 without reducing the thickness of the material.

Instead of crushing a portion on only one of the two arms which form a slot, smaller portions may be crushed on either side of a slot, on each of the adjacent arms.

The outer dimensions of the connection forks vary according to whether the forks are in the rest state or in the operating state. The dimension at the end of a fork in the rest state is smaller than the dimension at its base.

Different shapes can be imparted to the bosses. Further, this type of connector is applicable to connection forks with one or several (slots single-slot, double-slot, triple-slot connection forks, etc.)

Figure 5:
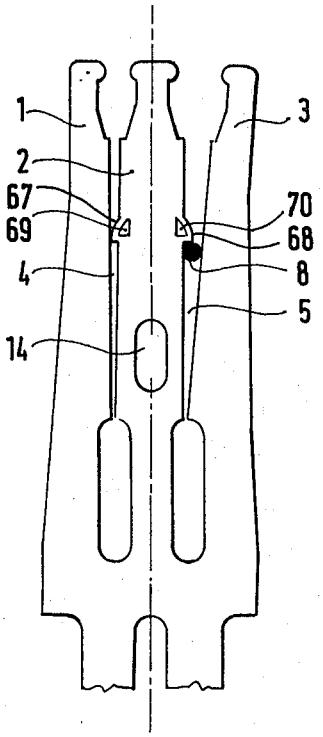
FIG. 5 is an elevation which shows another embodiment of a connector.

FIG. 5 shows a variant of a connector in which the bosses 67, 68 are somewhat "harpoon" shaped. They are formed by stamping with triangular dies 69,70. The shape of the bosses 67,68 allows the conductor wire 8 to be inserted while preventing it from being pulled out when a traction effort is exerted on this conductor wire in the direction of the opening of the slot.

Two wires are inserted, one in each slot, in a connection fork in the operating state. This moves the side arms and it is then observed that the dimensions at the end of the fork becomes greater than the dimension at its base. This is a disadvantage for inclusion in equipment where components must be miniature sized.

Figure 6:
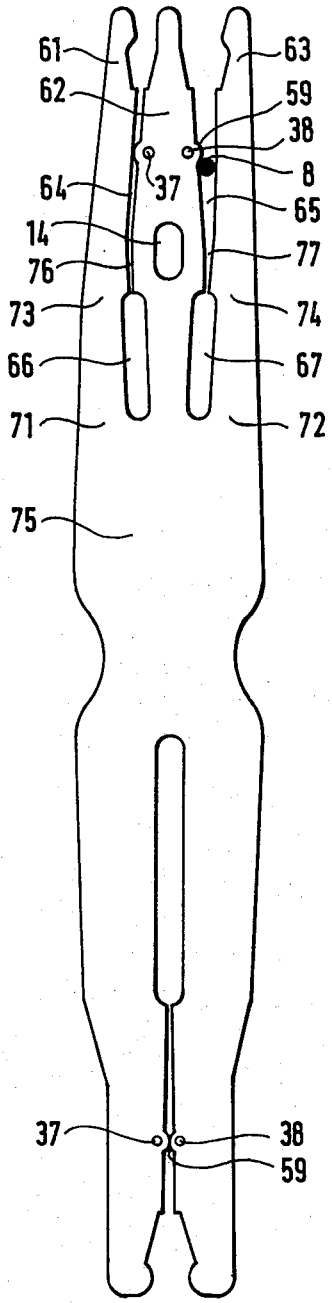
FIG. 6 is an elevational view of a multiple connector with a double fork on one side and a single fork on the other side.
Figure 7:
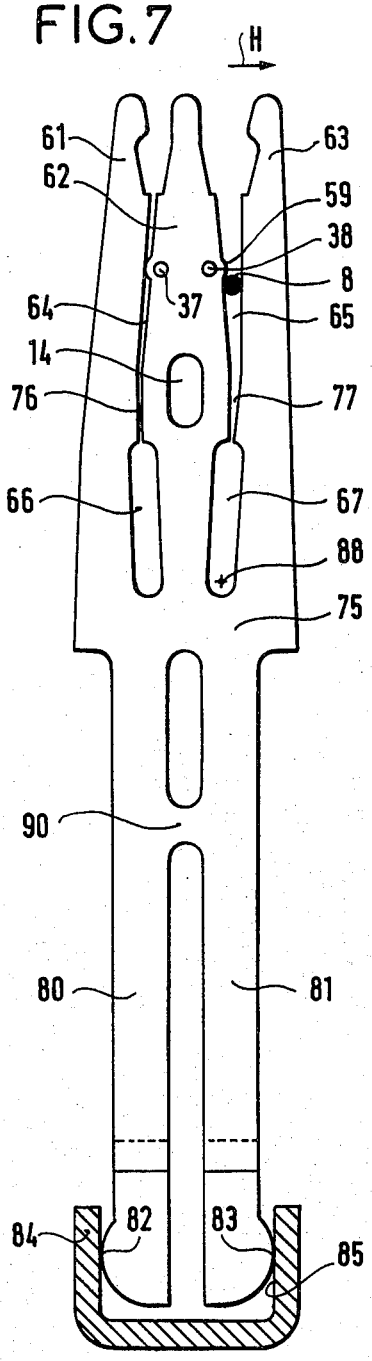
FIG. 7 is an elevational view of a connector with a double fork on one side and resilient contact arms on the other side.

FIGS. 6 and 7 show an embodiment which reduces the dimensions of the connection fork both at the end and at the base without thereby being detrimental to the mechanical characteristics from which the electrical characteristics are derived. The middle arm 62 is somewhat triangular in shape so that the slots 64 and 65 are not parallel but are placed along axes which converge towards a point situated beyond the top of the fork.

Likewise, the elongate apertures 66 and 67 provided in the base of the fork are not parallel but are placed along axes which converge towards a point situated beyond the base of the fork.

Slots 64 and 65 can be extended by slots 76,77 which are parallel to each other or are differently inclined relative to slots 64 and 65.

This disposition makes it possible to provide material of sufficient cross-section in the active portions of side arms 61 and 63, in particular firstly in zones 71 and 72 and secondly in zones 73 and 74, while reducing the dimensions at both the top and the base.

The right-hand portion of FIGS. 6 and 7 show such a fork in the operating state, in which fork a wire 8 is inserted, it is then observed that the lateral dimension at the top remains smaller than the lateral dimension at the base 75 of the fork.

The dispositions described can be used separately or in combination on single-slotted or double-slotted forks. Furthermore, the base of the fork can be extended and end in different ways of which a few non-limiting examples are given hereinafter;

Combination of a single-slotted fork with a double-slotted fork, either head to tail (FIG. 6) or side by side.

Combination of two double-slotted forks either head to tail or side by side.

Combination of a double-slotted fork with radial pressure contacts for electrical connection via the surfaces of the outer edges (FIG. 7) or of the inner edges.

A double-slotted fork and a single-slotted fork combined with axial pressure contacts for electrical connection via the surfaces of the resilient arms.

Combination of a double-slotted fork with connection means using either double or single wire wrapping connections; these wire wrapping connections are of the wrapping or mini-wrapping type.

It is possible to combine together self-stripping fork contacts and pressure contacts, in particular radial pressure contacts with either outward or inward pressure, the forks being double-slotted forks ending in radially pressing contacts with outward pressure then inward pressure and single-slotted fork contacts with the fork ending in radial pressure contacts with outward pressure then inward pressure.

Although possible, such a disposition has its disadvantages. In particular, as far as concerns keeping the pressure contacts to their proper geometrical dimensions when the conductor wires are inserted in the forks.

The explanation refers to the example of FIG. 7 which illustrates a double-slotted fork ending in radial outward pressure contacts. In FIG. 7, the fork on the left-hand side is in the rest state (no conductor wire inserted) while the fork in the right-hand portion is in the operating state (conductor wire inserted).

This clip terminal, placed in an insulating support according to the preceding descriptions has its base extended by two resilient arms 80 and 81 provided with contact pieces 82 and 83 which in principle must press against the side of a U-shaped metal part 84.

When the fork is in the rest state as illustrated on the left-hand side of the figure, contact piece 82 is under pressure and therefore provides electrical contact with part 84.

When the fork is in the operating state as illustrated on the right-hand side of the figure, i.e. when a conductor wire 8 is inserted in slot 65, side arm 63 moves to the right in the direction shown by the arrow H, pivoting about an imaginary pivot point 88 located at the base of aperture 67. If bridge 90 did not exist, on pivoting, side arm 63 would draw resilient arm 81 with it, thus moving contact piece 83 of metal part 84 and hence reducing the contact pressure. Assuming that the left-hand portion of the fork is also in the operating position, the pressure then exerted by contact pieces 82 and 83 on metal part 84 could become zero, which would switch off the electric circuit.

To overcome this type of defect, resilient arms 80 and 81 are connected together by means of a bridge 90 whose function is to stop rotary movement being transmitted by side arm 63 to resilient arm 81, thereby keeping contact piece 83 permanently in contact at point 85 with metal part 84. Of course, the same reasoning applies also to the left-hand portion of the fork when said fork is also in the operating position. Therefore, no operation on the fork portion will have any effect on the pressure contact portion. Conversely, no operation on the pressure contact portion will have any effect on the fork portion.

We claim:

1. In a flat connector for self-stripping insulated electric conductors, said connector comprising:

a flat double fork conductive connection part comprising a central arm and two resiliently movable side arms with elongated slots between said central arm and said side arms for inserting the electric conductor to be connected, the connection part being insertable in a narrow width cavity in a stand made of insulating material, means for fixedly mounting a central arm to said stand with said side arms flexible laterally within said cavity, and wherein said longitudinal slots are inclined at least along a portion of their length with the angles of inclination converging towards the ends of said arms.

2. A connector according to claim 1, wherein the connection part further includes apertures (66, 67) opening to the ends of said longitudinal slots remote from the ends of said arms and diverging in a direction toward said slots to provide elasticity, and with the axes of the apertures converging towards the base of the connector.

3. A connector according to claim 1, wherein the wire receiving slots and the apertures for providing elasticity to the arms are placed on axes which converge respectively towards a point situated beyond the ends of the connector arms and towards a point situated beyond the base of the connection part, thus providing a more compact connector.

4. A connector according to claim 2, wherein the conductor receiving slots comprise two differently inclined slot portions including a straight portion (76) aligned with the inclined apertures and a converging inclined portion proximate to the ends of said arms.

5. A flat connector for self-stripping insulated electric conductors, said connector comprising: a double fork type conductive connection part including a middle arm resiliently moving side arms on opposite sides thereof and defining with said middle arm elongated conductor receiving slots, the connection part being insertable in a cavity in a stand made of insulating material such that the side arms flex laterally relative to the middle arm, and wherein said middle arm (2) has a hole (14) for receiving a stud (13) of the support to hold the middle arm motionless when a connection wire is inserted in one of the slots of the connection part with a side arm flexing laterally to permit insertion of the connection wire.

* * * * *